US005170702A

United States Patent [19]

Schwelling

[11] Patent Number: 5,170,702

[45] Date of Patent: Dec. 15, 1992

[54] BALING PRESS FOR MAKING HIGHLY COMPRESSED BOUND BALES OF WASTE MATERIAL

[76] Inventor: Hermann Schwelling, Hartmannweg 5, D-7777 Salem 2, Fed. Rep. of Germany

[21] Appl. No.: 728,561

[22] Filed: Jul. 11, 1991

[30] Foreign Application Priority Data

Jul. 13, 1990 [DE] Fed. Rep. of Germany ..... 4022324

[51] Int. Cl.[5] ..... B65B 13/28; B65B 27/12

[52] U.S. Cl. ..... 100/19 R; 100/11; 100/31

[58] Field of Search ..... 100/8, 11, 17, 18, 19 R, 100/31, 33

[56] References Cited

U.S. PATENT DOCUMENTS

| | | | |
|---|---|---|---|
| 999,200 | 8/1911 | Bowers | 100/11 |
| 1,889,372 | 11/1932 | Nolan | 100/19 R X |
| 2,173,403 | 9/1939 | Trimble | 100/19 R X |
| 2,595,503 | 5/1952 | Altgelt | 100/11 |
| 2,621,588 | 12/1952 | McClellan et al. | 100/19 R X |
| 2,732,790 | 1/1956 | Leary | 100/31 X |
| 3,667,377 | 6/1972 | Persson | 100/19 R |
| 3,789,751 | 2/1974 | Burford | 100/19 R |
| 4,092,913 | 6/1978 | Tea | 100/31 X |
| 4,718,336 | 1/1988 | Munro | 100/31 X |

FOREIGN PATENT DOCUMENTS

| | | | |
|---|---|---|---|
| 274624 | 5/1914 | Fed. Rep. of Germany | 100/11 |
| 49910 | 9/1939 | France | 100/11 |
| 604961 | 5/1960 | Italy | 100/19 R |

*Primary Examiner*—Harvey C. Hornsby
*Assistant Examiner*—Stephen F. Gerrity
*Attorney, Agent, or Firm*—Anderson Kill Olick & Oshinsky

[57] ABSTRACT

A baling press for automatically and mechanically placing and binding one or more binding wires around highly compressed bales of waste material. The baling press includes for each binding plane a separate feeding station, cutting station and twisting station on the opposite side of the pressing shaft. The feeding elements are not mechanically or positively connected to each other. Rather, the feeding elements are all connected to the same pulse generator for carrying out the control of the feeding elements.

4 Claims, 3 Drawing Sheets

BALING PRESS FOR MAKING HIGHLY COMPRESSED BOUND BALES OF WASTE MATERIAL

BACKGROUND OF THE INVENTION

1. Field of the Invention

The present invention relates to a baling press for making highly compressed, bound bales of waste material. The baling press includes an arrangement for automatically and mechanically placing and binding one or more binding wires around highly compressed bales of waste material. The baling press further includes a pressing shaft and a corresponding pressing piston. The binding wires are guided along the outer walls of the pressing shaft to twisting stations. The twisting stations include wire feeding units which act transversely of the direction of operation of the pressing piston. The wire feeding units include drive cylinders, piston rods with wire guiding heads and a cutting die mounted on the wire guiding heads for severing the wire.

2. Description of the Related Art

The present invention starts from a method and corresponding arrangement according to German patent 33 46 051 and European patent 0 149 774 of the same applicant. This known arrangement has been used in practice with great success for several years. However, it has been found that the known arrangement requires some improvements in several respects in order to absolutely optimize the arrangement for all types of operation and for avoiding completely all interruptions in operation.

SUMMARY OF THE INVENTION

Therefore, it is the object of the present invention to improve the following features or to provide the following new features to the known arrangement:

a) constructing the wire feeding head and twisting fingers of the wire twisting stations in such a way that these components cannot collide with each other in any position thereof;

b) the binding wires should be guided toward each other as closely as possible at the twisting locations while avoiding wire deflections in the range of 90°;

c) means should be provided for ensuring an always correct cutting position of the wire cutting die, even when the pressing plate is loaded unilaterally; and d) means are to be provided for preventing the binding wires from jumping away when the cut has been made too early and the wires are not yet fully grasped by the twisting fingers.

In accordance with the present invention, the above-described object is met by the following features:

a) the wire guiding head which supports the cutting die and guide rollers has a narrower width than the dimension of lateral guide members of the head of the piston rod and, in its end position or cutting position, the wire guiding head is positively guided and centered by stop members located laterally relative to an anvil;

b) the hook-shaped twisting fingers have spindles which include an offset of such a dimension which ensures that in any position of the machine the wire guiding head is located with its path of movement always outside of the circular path described by the twisting fingers; and c) fork-shaped catching hooks extend from the outer walls of the pressing shaft on both sides thereof to the twisting fingers and surround with play to all sides the binding wires on the twisting and feeding side.

The various features of novelty which characterize the invention are pointed out with particularity in the claims annexed to and forming a part of this disclosure. For a better understanding of the invention, its operating advantages and specific objects attained by its use, reference should be had to the drawing and descriptive matter in which there is illustrated and described a preferred embodiment of the invention.

DESCRIPTION OF THE PREFERRED EMBODIMENT

Figure 1:
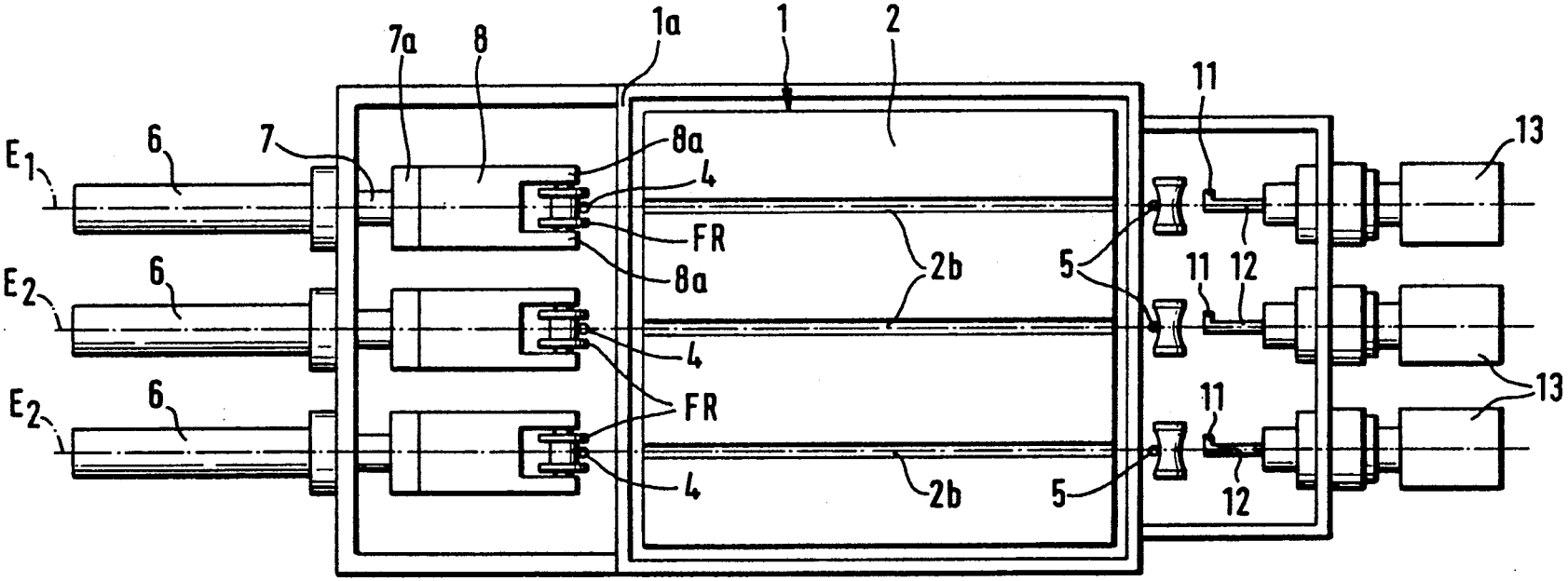
FIG. 1 is a schematic front view of a baling press according to the present invention.
Figure 2:
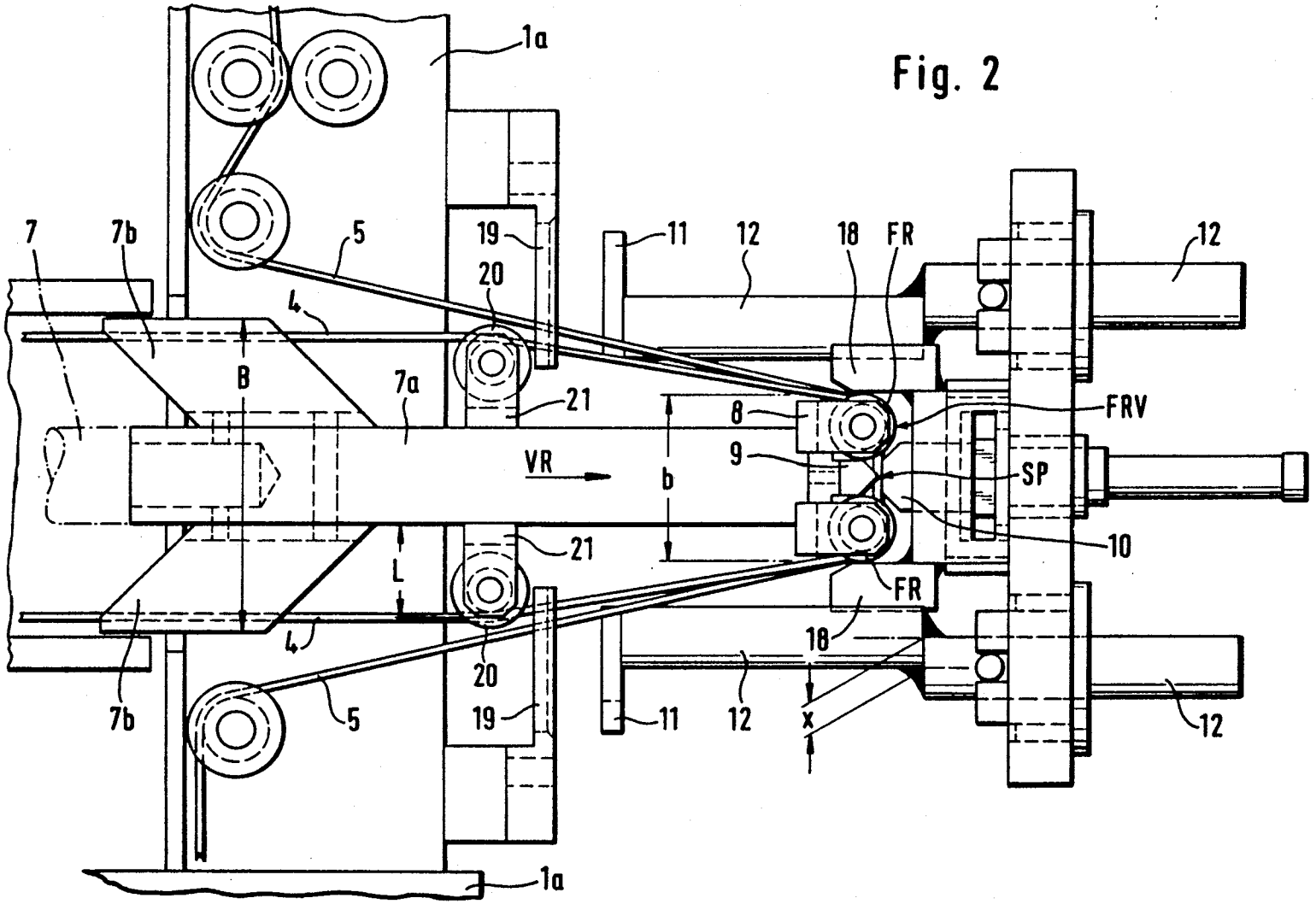
FIG. 2 is a side view, on a larger scale, of a twisting station of the baling press of FIG. 1.

FIGS. 1 and 2 of the drawing schematically show the basic construction of the novel binding arrangement according to the present invention. FIGS. 1 and 2 especially show that individual hydraulically moved piston-cylinder units 6, 7, 7*a*, 8 which are mechanically not coupled to each other are arranged on the pressing shaft 1 in each binding plane $E_1$, $E_2$, $E_3$ primarily for moving the binding wires 4, 5 from the side walls of the pressing shaft 1 into the area of the twisting spindles 12 or twisting fingers 11. Each of the piston rods has at its free end projecting out of the hydraulic cylinder 6 a rod head 7*a* which is centered in the known manner in its end position by means of guide members 7*b* in the pressing piston 2.

The free end of each rod head has additionally in the known manner next to the guide rollers FR for the binding wires 4, 5 a cutting die 9 located centrally between the rollers FR, wherein the tip Sp of the cutting die 9 is slightly rearwardly offset in feeding direction VR of the piston rod 7 relative to the front edges FRV of the guide rollers. In the same line of operation is provided an anvil 10 for each binding plane $E_1$, $E_2$, $E_3$ opposite each cutting die 9. Each anvil 10 is mounted resiliently yielding in axial direction. In its end position moved to block, the anvil 10 rests against or presses down a switching member, not shown, of the machine control.

The following features of the baling press according to the present invention are of particular significance:

a) The wire guiding head 8 which supports the cutting die 9 and the guide rollers FR have a narrower width b than the dimension B of the lateral guide members 7*b* of the head 7*a* of the piston rod 7 and, in its end or cutting position, the wire guiding head 8 is, additionally, positively guided and centered by two stop members 18 located laterally relative to an anvil 10.

Figure 3:
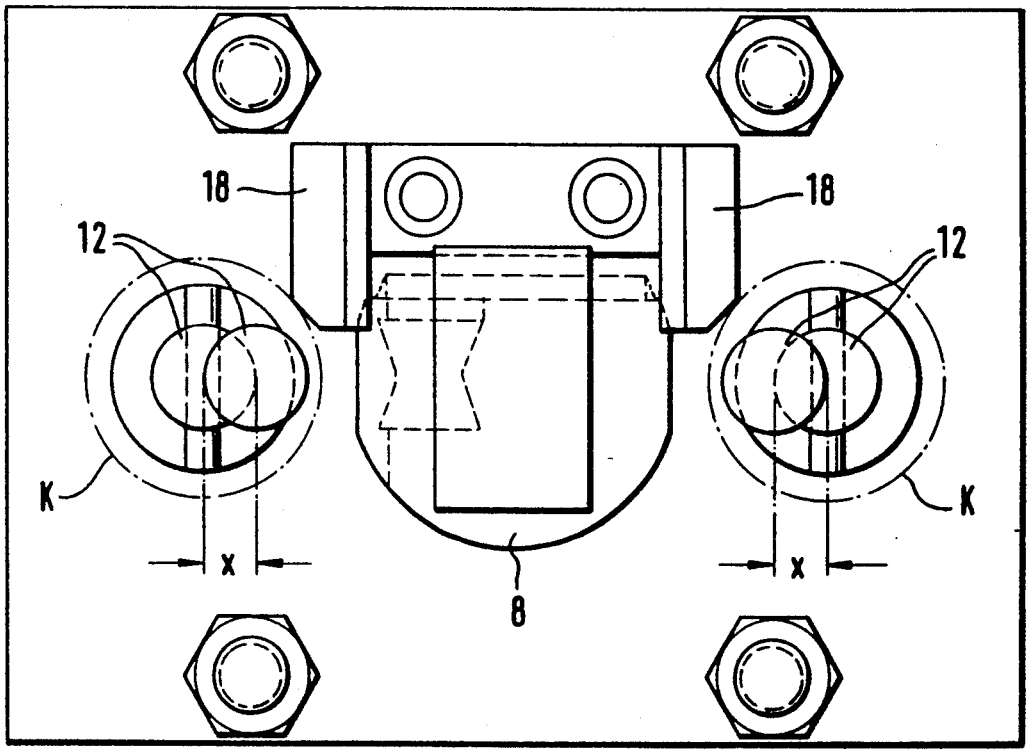
FIG. 3 is a front view of the twisting station of FIG. 2.

The above feature ensures that, due to its greater distance from the wall, i.e., a play in the region of the passage openings in the areas of the pistons, the narrow wire guiding head pulls along virtually no waste material and does not push waste material into the area of the anvil 10. In addition, the cutting dies 9 are always in an optimum cutting position even when the pressing plate is loaded unilaterally.

b) The hook-shaped twisting fingers 11 have spindles 12 which are offset by such a dimension x which ensures that in any position of the machine the wire guiding head 8 is located with its path of movement always outside of the circular path K of the twisting fingers 11, as is particularly clear from FIG. 3.

The above-described offset provides the additional advantage that at the actual twisting location the fingers 11 only describe a small circle of rotation, so that the twisting result is improved and the pretensioned wires 4, 5 are not excessively loaded.

c) Fork-shaped catching hooks 19 extend from the outer walls 1*a* of the pressing shaft 1 on both sides thereof to the twisting fingers 11 and surround with play to all sides the binding wires 4, 5 on the twisting and feeding side.

Accordingly, the catching hooks are means for preventing the binding wires from jumping away when the cut has been made too early and the wires are not yet fully grasped by the twisting fingers.

Another important feature of the present invention provides that another pair of guide rollers 20 for the wire 4 on the feeding side are provided on appropriate brackets 21 between the wire guiding head 8 and the piston rod head 7*a*, wherein the length L of the brackets 21 is dimensioned in such a way that the wires 4 on the feeding side which run over the guide rollers 20 are moved closely to the wires 5 on the twisting side. This advantageous arrangement has the result that the binding wires 4 and 5 extend only with deflections of more than 90° which, among other advantages, leads to a significant reduction of the force required for the feeding of the wire.

In accordance with another important structural feature, in the cutting position, the additional guide rollers 20 are located immediately in front of the catching hooks 19 seen in feeding direction VR; in addition, as the wire is being fed through, the wires 4 running over the guide rollers 2*a* stabilize the entire feeding unit.

While a specific embodiment of the invention has been shown and described in detail to illustrate the application of the inventive principle, it will be understood that the invention may be embodied otherwise without departing from such principles.

I claim:

1. A baling press for making highly compressed, bound bales of waste material, and for automatically and mechanically placing and binding binding wires around highly compressed bales of waste material, comprising:

a pressing shaft having outer walls;

a pressing piston in the pressing shaft;

means for guiding the binding wires along outer walls of the pressing shaft to twisting stations;

wire feeding units having a direction of operation transversely of the direction of operation of the pressing piston;

drive cylinders and piston rods with wire guiding heads, wherein said wire feeding units include said drive cylinders and said piston rods;

a cutting die mounted on the wire guiding heads for severing the wire wherein each wire guiding head which supports the cutting die and guide rollers having a narrower width than a width of lateral guide members of a head of the piston rod and wherein the wire guiding head is movable into an end position or cutting position and is positively guided and centered in the end position or cutting position by stop members located laterally relative to an anvil;

hook-shaped twisting fingers with spindles, wherein said spindles include an offset dimensioned such that the wire guiding head is located with a path of movement always outside of a circular path described by the twisting fingers; and fork-shaped catching hooks extending from outer walls of the pressing shaft on both sides of the shaft to the twisting fingers and surrounding with play to all sides the binding wires on a twisting and feeding side.

2. The baling press of claim 1, further comprising an additional pair of guide rollers for the wires on the feeding side, wherein the additional guide rollers are arranged on brackets between the wire guiding head and a piston rod head.

3. The baling press of claim 2, wherein the brackets have a length dimensioned such that the wires extending over the additional guide rollers are moved closely to the wires on the twisting side.

4. The baling press of claim 2, wherein, in a cutting position, the additional guide rollers are located immediately in front of the catching hooks in the direction of feeding.

* * * * *